US007311293B2

(12) United States Patent
Mrugalski, Jr.

(10) Patent No.: US 7,311,293 B2
(45) Date of Patent: Dec. 25, 2007

(54) MULTI-USE HAND TOOL FOR FRAMING

(76) Inventor: Florian Mrugalski, Jr., 324 Picketts Cir., Indian Trail, NC (US) 28079

( * ) Notice: Subject to any disclaimer, the term of this patent is extended or adjusted under 35 U.S.C. 154(b) by 0 days.

(21) Appl. No.: 11/548,707

(22) Filed: Oct. 12, 2006

(65) Prior Publication Data

US 2007/0125991 A1 Jun. 7, 2007

Related U.S. Application Data

(60) Provisional application No. 60/739,515, filed on Nov. 23, 2005.

(51) Int. Cl.
*B66F 15/00* (2006.01)

(52) U.S. Cl. ..... 254/25; 254/21

(58) Field of Classification Search ..... 254/25, 254/21, 18, 131.5
See application file for complete search history.

(56) References Cited

U.S. PATENT DOCUMENTS 845,672 A * 2/1907 Thompson ..... 254/25
1,445,263 A 2/1923 Asper
1,475,371 A 11/1923 Davis
2,382,831 A * 8/1945 Tabellione ..... 254/25
2,585,013 A 2/1952 Johnson
2,718,374 A 9/1955 Kellenbarger
2,896,910 A 7/1959 Cooper et al.
2,937,004 A 5/1960 Striani
D275,446 S 9/1984 McSwain
4,826,136 A 5/1989 Thomas
D336,231 S 6/1993 Strom
D351,326 S 10/1994 Schwengel
5,850,650 A 12/1998 Karsnia
D417,600 S 12/1999 Heatwole
D450,992 S 11/2001 Abshire
6,409,152 B1 * 6/2002 Bagley ..... 254/18
7,039,993 B1 * 5/2006 Smith et al. ..... 29/235
2005/0062026 A1 * 3/2005 Holcomb ..... 254/25
2006/0137291 A1 6/2006 Jensen

* cited by examiner

*Primary Examiner*—Lee D. Wilson
(74) *Attorney, Agent, or Firm*—Hammer & Hanf, P.C.

(57) ABSTRACT

A multi-use hand tool for framing includes a shaft, a head, a notch, and a close space. The head is attached to the shaft and includes an open space adapted to fit a board. The notch is adapted for pulling nails. The closed space is adapted for pulling long nails.

18 Claims, 4 Drawing Sheets

MULTI-USE HAND TOOL FOR FRAMING

RELATED APPLICATION

This application claims the benefit of U.S. Provisional application Ser. No. 60/739,515 filed Nov. 23, 2005.

FIELD OF INVENTION

The instant application relates to hand tools used for framing.

BACKGROUND OF THE INVENTION

Framing is a term used to describe the process of erecting a framed structure, usually out of lumber. The floors, walls and roof of a framed structure are created by assembling consistently-sized framing elements of dimensional lumber (2×4, 2×6, etc.), at consistent spacing (12", 16", & 24" on center). The floors, walls, and roof are typically made torsionally stable with the installation of sheathing. Spacing the studs properly allows them to align with the edges of standard sheathing. Thus, there is a need for a tool for properly spacing the studs.

Two by fours that skilled craftsman use to construct houses and buildings are often provided as twisted or bowed which makes their use more of a challenge. Often it may take two people to put up a stud instead of one because of imperfections in the lumber. It often takes one person to manipulate (push, pull, twist) a board into position so that a second person can secure it with a fastener such as a nail. Therefore, there is a need for a tool that allows a person to manipulate boards into position for framing.

Typically, the manipulation of the board by the framer was accomplished by hand. The framer would grasp the stud with one hand and twist until the end of the stud was square with the particular plate. While still grasping the stud, the framer would then attempt to nail the stud to the plate, typically with an air nail gun. Because the framer has to manipulate the board down near the target area of the nail gun, there is a risk of injury to the framer from a misfire from the nail gun. Thus, there is a need for a tool that allows a framer to manipulate studs from an elevated distance.

During the process of framing, framers often times have to loosen boards. To save on lumber costs, it is important that the boards are loosened without damaging the wood and the nails removed from the boards so that the boards can be reused. One way to loosen a board without damaging it would be to first pry the board loose and then to pull the nails from the board. Therefore, there is a need for a tool that allows a framer to pry a board loose and remove the nails from the board.

Framers today typically carry around numerous tools to aid in the different tasks that may take place during the process of framing. These tools can be heavy and cumbersome. For safety concerns, because framing may take place in many different places and elevations, it is safest for the framer to carry as little tools as possible. Thus, there is a need for a single tool that can accomplish multiple framing tasks.

The instant invention is designed to address all of these problems.

SUMMARY OF THE INVENTION

The instant invention is a multi-use hand tool for framing. The multi-use hand tool includes a shaft, a head, a notch, and a closed space. The head is attached to the shaft and includes an open space adapted to fit a board. The notch is adapted for pulling nails. The closed space is adapted for pulling long nails.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
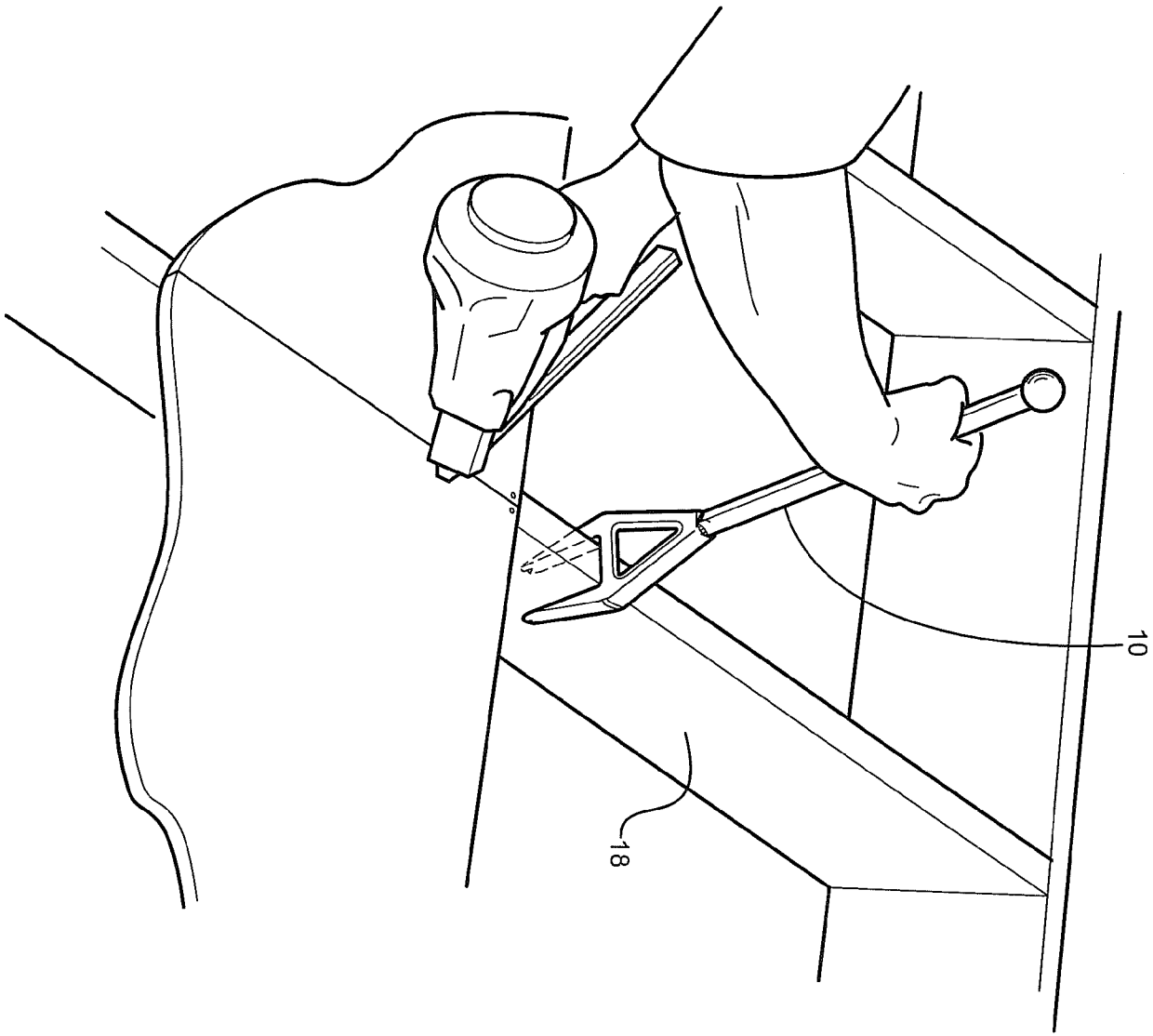
FIG. 1 is an environmental view of one embodiment of the multi-use hand tool for framing.

Referring to the drawings, wherein like numerals indicate like elements, there is shown in FIG. 1 an embodiment of a multi-use hand tool 10 for framing. Multi-use hand tool 10 includes a shaft 12, and a head 14 (see FIG. 2). Multi-use hand tool 10 may be used during the many processes of framing, including, but not limited to, manipulating studs (see FIG. 1), measuring the distance between studs, prying boards apart, removing nails, etc. Multi-use hand tool 10 may have a length 28 (see FIG. 2). Multi-use hand tool 10 may be made as one solid unit or multiple units. Multi-use hand tool 10 may be cast or molded out of steel or aluminum. Multi-use hand tool 10 may be a two piece unit with a hollow shaft 12 affixed to a solid head 14 in order to decrease the weight of the overall tool. Multi-use hand tool 10 may include a closed space 22 (see FIG. 2) and a notch 20 (see FIG. 3) for pulling nails.

Figure 2:
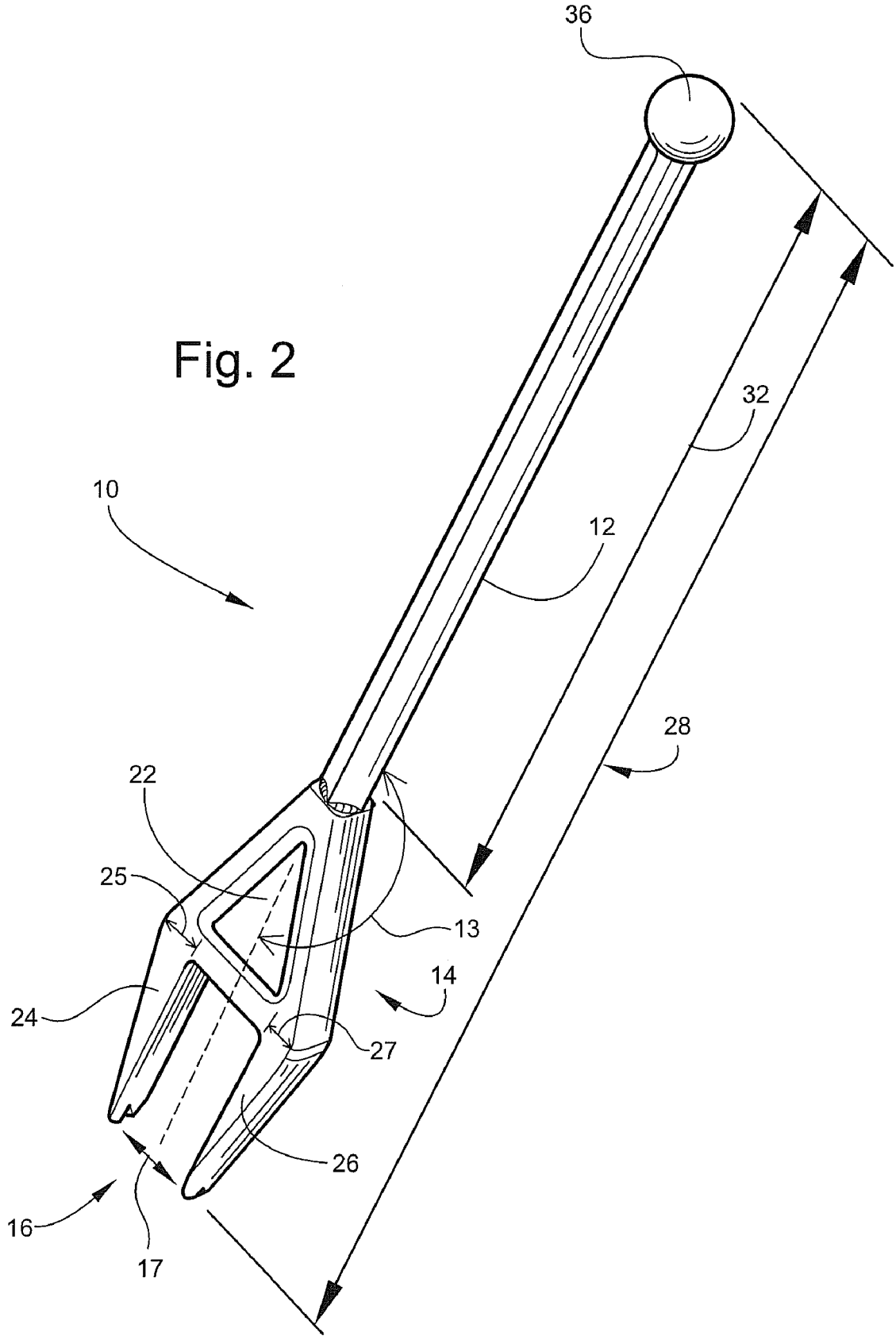
FIG. 2 is an isometric view of one embodiment of the multi-use hand tool for framing.

Shaft 12 may be included in multi-use hand tool 10 and attached to head 14 (see FIG. 2). Shaft 12 may be for providing a place for the framer to grip multi-use hand tool 10. Shaft 12 may be any length. Shaft 12 may be long enough to provide leverage to the framer to manipulate a standard stud 18. Shaft 12 may be long enough to provide leverage to the framer to pull nails. Shaft 12 may have a measuring means 32 and a rounded end 36 (see FIG. 2) or a hammerable end 37 (see FIG. 4. Shaft 12 may be solid or hollow.

Head 14 may be included in multi-use hand tool 10 (see FIG. 2). Head 14 may be attached to shaft 12. Head 14 may be for providing the location of an open space 16. Head 14 may include open space 16 defined by a first wedge shaped tine 24 and a second wedge shaped tine 26. Head 14 may include closed space 22, and notch 20. Head 14 may be made out of any material, including, but not limited to, steel or aluminum.

Figure 4:
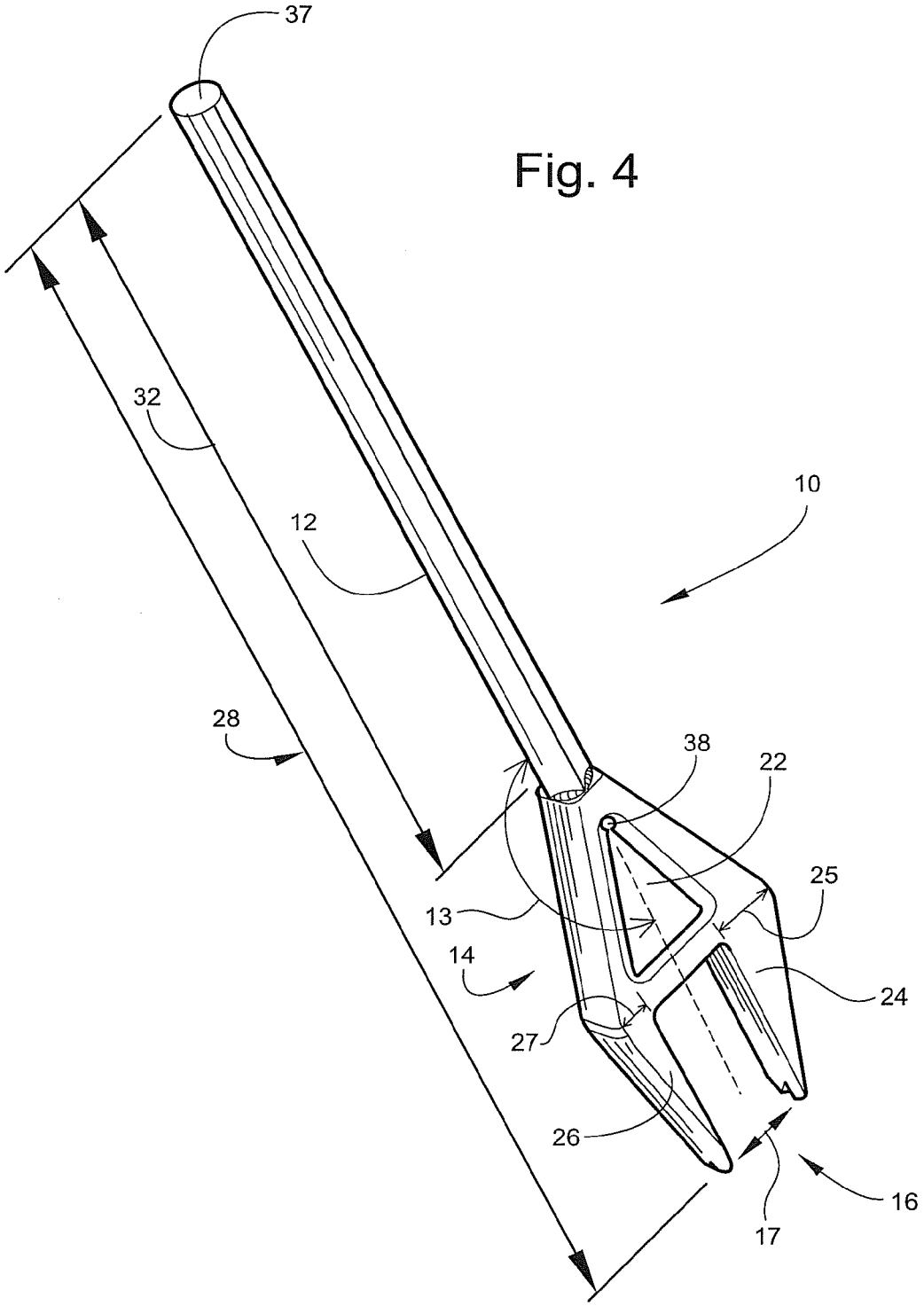
FIG. 4 is an isometric view of one embodiment of the multi-use hand tool for framing.

First wedge shaped tine 24 may be included in head 14 (see FIG. 2). First wedge shaped tine 24 may be for pulling nails. First wedge shaped tine 24 may include notch 20. First wedge shaped tine 24 may have a first width 25. First width 25 may be any width, including, but not limited to, equal to a second width 27 of second wedge shaped tine 26 (as illustrated in FIG. 2) or wider than second width 27 (as illustrated in FIG. 4). In one embodiment, first width 25 may be wider than second width 27 (see FIG. 4) to provide more leverage for pulling nails with notch 20.

Second wedge shaped tine 26 may be included in head 14 (see FIG. 2). Second wedge shaped tine 26 may be for prying boards loose. Second wedge shaped tine 26 may include second width 27. Second width 27 may be any width, including, but not limited to, equal to first width 25 (as illustrated in FIG. 2) or thinner than first width 25 (as illustrated in FIG. 4). In one embodiment, second width 27 may be thinner than first width 25 (see FIG. 4) to allow it to more easily fit between boards for prying the boards loose.

Rounded end 36 may be attached to the distal end of shaft 12 (see FIG. 2). Rounded end 36 may be for providing a means for gripping the end of shaft 12. Rounded end 36 may be any shape for providing a means for gripping the end of shaft 12, including, but not limited to circular.

Hammerable end 37 may be attached to the distal end of shaft 12 (see FIG. 4). Hammerable end 37 may be for providing a surface that allows multi-use hand tool 10 to be hammered into position under boards, nails, etc. Hammerable end 36 may be any type of surface that allows multi-use hand tool 10 to be hammered into position, including, but not limited to, a flat surface.

In combination, first wedge shaped tine 24 and second wedge shaped tine 26 may be for defining open space 16 (see FIG. 2). First wedge shaped tine 24 and second wedge shaped tine 26 may be spaced apart with their inner walls extending parallel to define open space 16. The two wedge shaped tines may be any length, including but not limited to, approximately the same length. The inner walls of the two wedge shaped tines may extend any direction from head 14, including, but not limited to, parallel to the longitudinal axis of shaft 12, perpendicular to the longitudinal axis of shaft 12, or any angle there between. In one embodiment, the inner walls of the two wedge shaped tines may extend from head 14 approximately parallel to the longitudinal axis of shaft 12. The inner walls of the two wedge shaped tines extending parallel to the longitudinal axis of shaft 12 may allow a framer to manipulate standard stud 18 from an elevated distance.

Open space 16 may be included in head 14 and defined by the two wedge shaped tines (see FIG. 2). Open space 16 may be for providing a space to grip standard stud 18 to allow multi-use hand tool 10 to manipulate standard stud 18 (see FIG. 1). Open space 16 may be adapted to fit standard stud 18. Open space 16 may have a width 17 (see FIG. 2). Open space 16 may extend from shaft 12 at an angle 13.

Angle 13 may be the angle open space 16 may extend from shaft 12. Angle 13 may allow open space 16 to extend any direction from the longitudinal axis of shaft 12, including but not limited to, one hundred and eighty (180) degrees from the longitudinal axis of shaft 12, ninety (90) degrees from the longitudinal axis of shaft 12, and any angle in between. In one embodiment, angle 13 may be one hundred and eighty (180) degrees.

Width 17 may be the width of open space 16 (see FIG. 2). Width 17 may be slightly wider than the thickness of standard stud 18. Width 17 may be slightly wider than two inches.

Standard stud 18 may be manipulated by multi-use hand tool 10 (see FIG. 1). Standard stud 18 may be any piece of lumber, including, but not limited to, a standard board with a two (2) inch thickness. Standard boards with a two (2) inch thickness include: a two inch by four inch standard board, a two inch by six inch standard board, a two inch by eight inch standard board, a two inch by ten inch standard board, etc.

Figure 3:
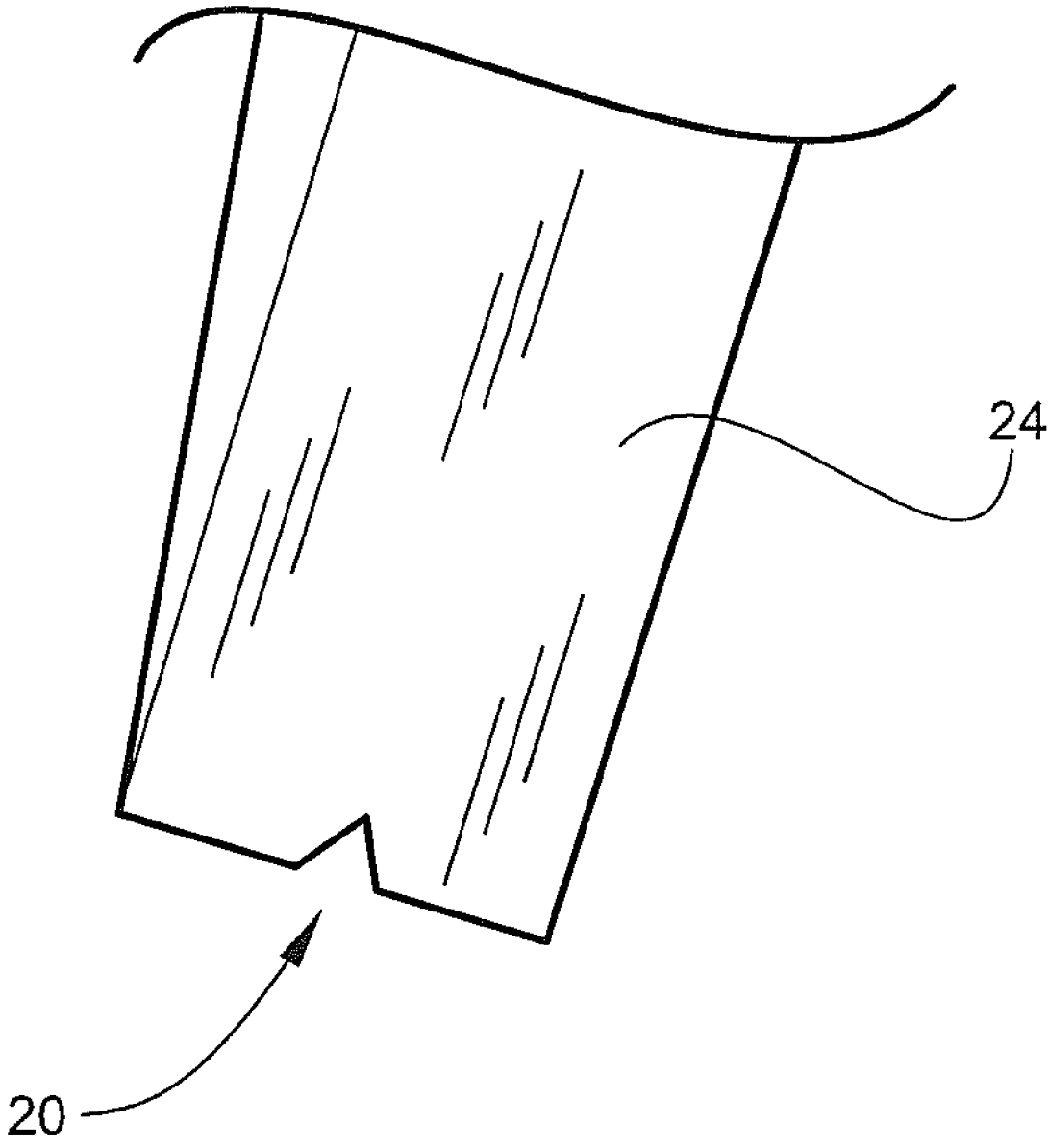
FIG. 3 is an isometric view of one of the tines having a notch.

Notch 20 may be included in multi-use hand tool 10 (see FIG. 3). Notch 20 may be adapted for pulling nails. Notch 20 may be located anywhere on multi-use hand tool 10, including but not limited to, the distal end of first wedge shaped tine 24, the distal end of second wedge shaped tine 26, and the distal end of shaft 12. In one embodiment, notch 20 may be located at the distal end of first wedge shaped tine 24 (see FIG. 3). Notch 20 may be a triangular shaped notch for providing a point at the apex for gripping the nail head.

Closed space 22 may be included in multi-use hand tool 10 (see FIG. 2). Closed space 22 may be adapted for pulling long nails. Closed space 22 may be located away from the ends of multi-use hand tool 10 to provide the leverage and length for pulling long nails. In one embodiment, closed space 22 may be located away from the distal end of head 14 on head 14 (see FIG. 2) or shaft 12. Closed space 22 may also be located away from the distal end of shaft 12 on shaft 12. Closed space 22 may be any shape. In one embodiment, closed space 22 may be relatively triangular shaped for providing a large space for inserting the nail at the base and providing a point at the apex for gripping the nail head. The point at the apex may include a second notch 38 (see FIG. 4) for aiding in gripping the nail head.

Multi-use hand tool 10 may have a total length 28 (see FIG. 2). Total length 28 may be any distance. Total length 28 may be for measuring a first distance between studs when framing. The first standard distance between studs may be any distance, including, but not limited to, twenty-two and one half (22½) inches.

Measuring means 32 may be included on shaft 12 (see FIG. 2). Measuring means 32 may be for measuring a second distance between studs. The second standard distance between studs may be any length, including, but not limited to, fourteen and one half (14½) inches. Measuring means 32 may be any way of measuring the second standard distance on shaft 12, including, but not limited to, markings, indentations, bulges, etc. In one embodiment, measuring means 32 may be the length of shaft 12 (see FIG. 2).

In operation, multi-use hand tool 10 may be used for many framing tasks. These framing tasks include, but are not limited to, measuring the distance between studs, manipulating the studs into place, prying boards loose, and pulling nails.

Measuring the distance between studs may be accomplished with multi-use hand tool 10. Total length 28 of multi-use hand tool 10 may be twenty-two and one half (22½) inches long, a first standard distance between studs. Thus, multi-use hand tool 10 may be used to measure the distance between studs that require twenty-four (24) inches on center spacing. Also, shaft 12 may be a second standard distance between studs, fourteen and one half (14½) inches long. Thus shaft 12 may be used to measure the distance between studs that require sixteen (16) inches on center spacing.

Manipulating the studs into place, or aligning the studs by twisting, pulling, and/or pushing the studs, may be accomplished with multi-use hand tool 10. A stud, like standard stud 18, may be partially or all the way inserted into open space 16 (see FIG. 1). Once in open space 16, standard stud 18 may be twisted, pulled, and/or pushed by the framer by twisting, pulling, and/or pushing shaft 12. Shaft 12 may provide the leverage needed for a single person to manipulate any stud, including bowed or imperfect studs, into place. Because open space 16 may extend one hundred and eighty (180) degrees from shaft 12, the hands of the framer may be at an elevated distance from the stud when the stud is aligned and nailed into place, thereby reducing the risk of injury from a misfire.

Prying boards loose may be accomplished with multi-use hand tool 10. Second wedge shaped tine 26 may be inserted under a board in order to gain leverage for loosening the board. For boards that are hard to get under, hammerable end 37 may be used to hammer second wedge shaped tine 26 under the board. Once under the board the framer may pull up or push down on shaft 12 to provide the leverage to pry the board loose. This process provides a way of prying the board loose without having to damage the board, which in turn, may reduce the cost of lumber.

Pulling nails may be accomplished with multi-use hand tool 10. First wedge shaped tine 24 may be wedged under a nail head until the nail body is inserted into notch 20. For nails that are hard to get under, hammerable end 37 may be used to hammer first wedge shaped tine 24 under the nail head. Once in notch 20, the framer may push or pull down on shaft 12 for leverage to pull the nail. If the nail is too long to be pulled all the way out using notch 20, once the nail is partially pulled, the nail may be inserted into closed space 22. Once in closed space 22, because closed space 22 may be away from the ends of multi-use hand tool 10, the framer may pull up or push down on shaft 12 to provide the necessary leverage and length to pull long nails.

The present invention may be embodied in other forms without departing from the spirit and the essential attributes thereof, and, accordingly, reference should be made to the appended claims, rather than to the foregoing specification, as indicated in the scope of the invention.

I claim:

1. A multi-use hand tool for framing comprising:

a shaft a head attached to said shaft;

said head having a triangular closed space with two wedge shaped tines attached;

said two wedge shaped tines defining an open space configured to fit a standard stud;

a notch configured for pulling nails; and said closed space configured for pulling long nails.

2. The multi-use hand tool of claim 1 where said notch being located at the end of one of said wedge shaped tines.

3. The multi-use hand tool of claim 1 where said first wedge shaped tine being wider than said second wedge shaped tine.

4. The multi-use hand tool of claim 3 where said nail pulling notch being located at the distal end of said first wedge shaped tine.

5. The multi-use hand tool of claim 1 where said two wedge shaped tines being the same length.

6. The multi-use hand tool of claim 1 where said open space extending from the longitudinal axis of said shaft at an angle.

7. The multi-use hand tool of claim 6 where said angle being one hundred and eighty (180) degrees.

8. The multi-use hand tool of claim 6 where said angle being ninety (90) degrees.

9. The multi-use hand tool of claim 1 further having a length configured to be used for measuring a first standard distance.

10. The multi-use hand tool of claim 9 where said first standard distance between studs being twenty-two and one half (22½) inches.

11. The multi-use hand tool of claim 1 where said shaft having a measuring means configured to measure a second standard distance.

12. The multi-use hand tool of claim 11 where said second standard distance between studs being fourteen and one half (14½) inches.

13. The multi-use hand tool of claim 1 where said closed space being located in said head.

14. The multi-use hand tool of claim 1 where said closed space being triangular shaped.

15. The multi-use hand tool of claim 14 where said triangular shaped closed space having a second notch at its apex.

16. The multi-use hand tool of claim 1 where said shaft having a hammerable end.

17. The multi-use hand tool of claim 15 where said hammerable end being flat.

18. A multi-use hand tool for framing comprising:

a shaft having a measuring means with a length of fourteen and one half (14½) inches and a hammerable end;

a head attached to said shaft having two wedge shaped tines and a triangular shaped closed space configured for pulling long nails;

said triangular shaped closed space having a second notch at an apex;

said two wedge shaped tines having the same length and having their inner walls being parallel;

said first wedge shaped tine being wider than said second wedge shaped tine;

said first wedge shaped tine having a notch configured for pulling nails; and an open space defined by said wedge shaped tines extending one hundred and eighty (180) degrees from said shaft and being configured to fit a standard stud, where the total length of said tool being twenty-two and one half (22½) inches.

* * * * *